US010048624B2

(12) United States Patent
Ogura et al.

(10) Patent No.: US 10,048,624 B2
(45) Date of Patent: Aug. 14, 2018

(54) CONDUCTIVE ENDLESS BELT AND IMAGE FORMING APPARATUS

(71) Applicant: BRIDGESTONE CORPORATION, Tokyo (JP)

(72) Inventors: Takashi Ogura, Yokohama (JP); Tatsuya Urakawa, Yokohama (JP); Ryuuta Tanaka, Yokohama (JP)

(73) Assignee: BRIDGESTONE CORPORATION, Tokyo (JP)

( * ) Notice: Subject to any disclaimer, the term of this patent is extended or adjusted under 35 U.S.C. 154(b) by 0 days.

(21) Appl. No.: 15/306,555

(22) PCT Filed: Apr. 30, 2015

(86) PCT No.: PCT/JP2015/002295
§ 371 (c)(1),
(2) Date: Oct. 25, 2016

(87) PCT Pub. No.: WO2015/174042
PCT Pub. Date: Nov. 19, 2015

(65) Prior Publication Data

US 2017/0045845 A1 Feb. 16, 2017

(30) Foreign Application Priority Data

May 14, 2014 (JP) ..... 2014-100554

(51) Int. Cl.
*G03G 15/16* (2006.01)
*G03G 15/00* (2006.01)

(52) U.S. Cl.
CPC ..... *G03G 15/162* (2013.01); *G03G 15/00* (2013.01); *G03G 15/16* (2013.01); *G03G 2215/0129* (2013.01)

(58) Field of Classification Search
CPC ..... G03G 15/162
See application file for complete search history.

(56) References Cited

U.S. PATENT DOCUMENTS 3,925,508 A 12/1975 Agouri et al.
4,725,630 A * 2/1988 Magee ..... C08F 30/08 522/99

(Continued)

FOREIGN PATENT DOCUMENTS

CN 102402161 A 4/2012
JP 2007-225761 A 9/2007

(Continued)

OTHER PUBLICATIONS

International Search Report of PCT/JP2015/002295 dated Jun. 2, 2015.

(Continued)

*Primary Examiner* — Walter L Lindsay, Jr.
*Assistant Examiner* — Arlene Heredia Ocasio
(74) *Attorney, Agent, or Firm* — Sughrue Mion, PLLC

(57) ABSTRACT

This conductive endless belt can suppress a reduction in toner releasability. The conductive endless belt is used in an image forming apparatus and includes at least an endless base layer and a surface layer formed on an outermost surface of an outer periphery of the base layer. The surface layer is formed from a resin composition including ultraviolet curable resin and silicone resin. The silicone resin includes polysiloxane containing, per molecule, 4 or more of at least one of an acryloyl group and a methacryloyl group.

4 Claims, 2 Drawing Sheets

(56) References Cited

U.S. PATENT DOCUMENTS

| | | | | |
|---|---|---|---|---|
| 5,114,794 | A | 5/1992 | Sudo et al. | |
| 5,981,679 | A | 11/1999 | Takei et al. | |
| 5,991,590 | A * | 11/1999 | Chang | G03G 15/162 399/302 |
| 6,385,424 | B1 * | 5/2002 | Lee | G03G 15/11 399/237 |
| 9,465,328 | B2 * | 10/2016 | Sakamoto | G03G 15/162 |
| 2005/0074260 | A1 | 4/2005 | King et al. | |
| 2005/0266328 | A1 * | 12/2005 | Yanagawa | G03G 5/0542 430/66 |
| 2012/0064350 | A1 | 3/2012 | Honya et al. | |
| 2013/0149541 | A1 | 6/2013 | Sakamoto et al. | |
| 2013/0330560 | A1 * | 12/2013 | Honya | G03G 15/1605 428/411.1 |
| 2014/0286682 | A1 * | 9/2014 | Sakamoto | G03G 15/162 399/302 |
| 2015/0210797 | A1 * | 7/2015 | Tamura | C09D 7/125 428/335 |

FOREIGN PATENT DOCUMENTS

| | | | |
|---|---|---|---|
| JP | 2009-192901 | A | 8/2009 |
| JP | 2011-085896 | A | 4/2011 |
| JP | 2012-068558 | A | 4/2012 |
| JP | 2013-061551 | A | 4/2013 |
| JP | 2013257412 | A | 12/2013 |
| JP | 2014-006327 | A | 1/2014 |
| JP | 2016190973 | A * | 11/2016 |

OTHER PUBLICATIONS

Communication dated Mar. 29, 2018, from the State Intellectual Property Office of People's Republic of China in counterpart Application No. 201580025156.8.

* cited by examiner

P015052

CONDUCTIVE ENDLESS BELT AND IMAGE FORMING APPARATUS

CROSS REFERENCE TO RELATED APPLICATIONS

This application is a National Stage of International Application No. PCT/JP2015/002295, filed Apr. 30, 2015, claiming priority based on Japanese Patent Application No. 2014-100554, filed May 14, 2014, the contents of all of which are incorporated herein by reference in their entirety.

TECHNICAL FIELD

This disclosure relates to a conductive endless belt and an image forming apparatus.

BACKGROUND

One method of printing used in an image forming apparatus such as a printer, photocopier, or the like is an intermediate transfer method.

In an intermediate transfer method, for example in the case of color printing, as illustrated in FIG. 4, a toner image on photosensitive drums 101 corresponding to the colors black, yellow, magenta, cyan, and the like undergoes primary transfer to the surface of an endless intermediate transfer belt 102. The toner image (color image) on the intermediate transfer belt 102 then undergoes secondary transfer to a recording medium 103, such as paper. The toner image (color image) on the recording medium is fixed to the recording medium by a fixer 104. In FIG. 4, reference numeral 105 indicates a secondary transfer roller, and reference numeral 106 indicates a roller.

As the intermediate transfer belt, a conductive endless belt 1 with a multilayer structure, including a base layer 2 that is the belt body and a surface layer 3 on the base layer 2, is generally used. An example is shown in FIG. 1.

The toner image on the photosensitive drum undergoes primary transfer to the surface layer of the conductive endless belt and then undergoes secondary transfer from this surface layer onto the recording medium.

Accordingly, the conductive endless belt has the function of subjecting the toner image, which underwent primary transfer from the photosensitive drum, to secondary transfer to the recording medium. Therefore, the conductive endless belt is required to have the property of the toner image being transferred to the recording medium at the time of secondary transfer without remaining on the conductive endless belt, i.e. the conductive endless belt is required to have toner releasability.

If the toner releasability of the conductive endless belt is low, then the toner image that undergoes secondary transfer onto the recording medium may be insufficient, leading to a reduction in printing quality. Furthermore, if the toner releasability is low, the toner that remains on the conductive endless belt becomes waste toner, which lowers the usage efficiency of materials. This is undesirable in terms of saving resources.

Regarding conductive endless belts, for example in order to improve the transfer efficiency when transferring an image from the intermediate transfer belt to the recording medium, JP 2009-192901 A (PTL 1) discloses using, on the surface layer of the conductive endless belt used as the intermediate transfer belt, a hard coat layer that has a particular pencil hardness and contact angle.

CITATION LIST

Patent Literature

PTL 1: JP 2009-192901 A

SUMMARY

Technical Problem

In this way, the transfer efficiency when transferring an image from the intermediate transfer belt to the recording medium can be improved with the conductive endless belt disclosed in PTL 1. There is still room for improvement, however, in terms of suppressing a reduction in toner releasability that occurs over time due to use of the image forming apparatus.

It would therefore be helpful to provide a conductive endless belt that can suppress a reduction in toner releasability.

It would also be helpful to provide an image forming apparatus that can suppress a reduction in image quality.

Solution to Problem

A conductive endless belt according to this disclosure is used in an image forming apparatus and comprises at least an endless base layer and a surface layer formed on an outermost surface of an outer periphery of the base layer. The surface layer is formed from a resin composition including ultraviolet curable resin and silicone resin. The silicone resin includes polysiloxane containing, per molecule, 4 or more of at least one of an acryloyl group and a methacryloyl group (also referred to below simply as a "(meth)acryloyl group").

In this disclosure, an acryloyl group refers to $CH_2{=}CH{-}CO{-}$, and a methacryloyl group refers to $CH(CH_3){=}CH{-}CO$.

In this disclosure, the peel force of the surface layer is the peel force measured by the following method, as illustrated in FIGS. 2 and 3. First, a conductive endless belt 1 measuring 75 mm long by 25 mm wide is prepared. Next, onto the surface of a surface layer 3 thereof, a length of 45 mm of cellophane adhesive tape 4 (product name Cellotape® (Cellotape is a registered trademark in Japan, other countries, or both) CT-18), produced by Nichiban Co., Ltd. and measuring 55 mm long by 18 mm wide, is adhered to the surface layer 3 starting at one end (turnback end) thereof. The remaining 10 mm portion of the cellophane adhesive tape 4 is not adhered, but rather left in a peeled off state. Of the two clamps of an autoloader, one clamp 5 is then set to hold the end of the cellophane adhesive tape 4 that is in the peeled off state, and the other clamp 6 is set to hold the end of the conductive endless belt 1 to which the cellophane adhesive tape 4 is not adhered. Next, at a tension rate of 200 mm/min, the clamp 5 is pulled in a direction at 180° with respect to the clamp 6 until all of the cellophane adhesive tape 4 is peeled from the surface layer 3, and the force (N) at the time of pulling is measured. As illustrated in FIG. 3, the average is calculated for the interval over which the force (N) at the time of pulling is nearly constant (at least 70 mm within the length of 110 mm that can be pulled). This average is taken as the peel force (N). One of ordinary skill in the art will appreciate that toner releasability can be evaluated based on the peel force measured with the aforementioned method.

In this disclosure, a simplified endurance test refers to a test to rub a wiper (produced by Chiyoda Co., Ltd., product name Cotton Ciegal) measuring 20 mm×20 mm and impregnated with methanol (1 mL) against the surface of the surface layer of a conductive endless belt with a load of 4.9 N (0.5 kgf) back and forth 50 times.

Advantageous Effect

We thus provide a conductive endless belt that can suppress a reduction in toner releasability.

We also provide an image forming apparatus with excellent image quality.

DETAILED DESCRIPTION (Conductive Endless Belt)

Figure 1:
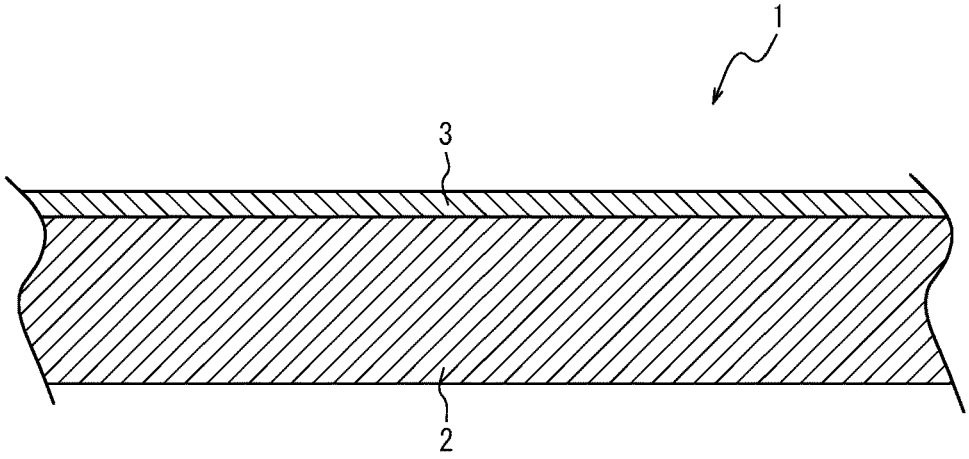
FIG. 1 is a cross-sectional diagram in the thickness direction schematically illustrating an example of a conductive endless belt according to this disclosure.

The conductive endless belt according to this disclosure includes, as essential components, a base layer that is an endless belt body and a surface layer formed on the outermost surface of the outer periphery of the base layer. Other layers such as a primer layer may be included between the base layer and the surface layer.

The conductive endless belt of this disclosure can suppress a reduction in toner releasability and can therefore be used suitably as an intermediate transfer belt in an image forming apparatus.

The base layer and surface layer that are essential components forming the conductive endless belt according to this disclosure and other layers that may be provided as necessary are now described in order with examples.

<Base Layer>

In the conductive endless belt according to this disclosure, the base layer is an essential component forming the endless belt body.

Any base layer may be used, such as the base layer in a conventionally known conductive endless belt.

As the resin constituting the base layer, for example thermoplastic resin may be used. Non-limiting examples of the thermoplastic resin include polyesters such as polyethylene terephthalate and polybutylene terephthalate; polyamide; polycarbonate; polyphenyleneoxide; polyolefins such as polyethylene, polypropylene, polybutene, and polystyrene; polyvinyl chloride; polyvinylidene chloride; polyvinylidene fluoride (PVDF); polymethylmethacrylate; polyurethane; polyacetal; polyvinyl acetate; acrylonitrile butadiene styrene resin; polyamide-imide; polyarylate; polysulfone; polysulfonamide; thermotropic liquid crystal polymers; and polyamide acid. Such thermoplastic resins may be used alone, or two or more kinds may be used in combination.

In order for the conductive endless belt to express conductivity, a known conductive agent is normally added to the base layer.

Any conductive agent may be added to the base layer. Examples include known electronically conductive materials and ion-conductive materials. Such conductive agents may be used alone, or two or more kinds may be used in combination.

Examples of electronically conductive materials include conductive carbon such as ketjen black EC and acetylene black; carbon for rubber such as SAF, ISAF, HAF, FEF, GPF, SRF, FT, and MT; carbon for color (ink) subjected to oxidation treatment or the like; pyrolytic carbon; natural graphite; artificial graphite; metals and metal oxides such as nickel, copper, silver, germanium, antimony-doped tin oxide, titanium oxide, and zinc oxide; conductive polymers such as polyaniline, polypyrrole, and polyacetylene; and the like.

Examples of ion-conductive materials include inorganic ion conductive materials such as sodium perchlorate, lithium perchlorate, calcium perchlorate, and lithium chloride; quaternary ammonium perchlorates, hydrosulfates, ethosulfates, methylsulfates, phosphates, and fluoroborates such as tridecylmethyldihydroxyethyl ammonium perchlorate, lauryltrimethyl ammonium perchlorate, modified aliphatic dimethylethyl ammonium ethosulfate, N,N-bis(2-hydroxyethyl)-N-(3'-dodecyloxy-2'-hydroxypropyl)methyl ammonium ethosulfate, stearamidopropyldimethyl-β-hydroxyethyl-ammonium-dihydrogen phosphate, tetrabutylammonium fluoroborate, stearyl ammonium acetate, and lauryl ammonium acetate; organic ion conductive materials such as acetate; charge-transfer complexes; and the like.

The conductivity of the base layer may be adjusted to the desired conductivity by addition of the aforementioned conductive agents. For example, the resistance may be set between $10^5$ Ω·cm and $10^{14}$ Ω·cm.

In addition to the conductive agents, known additives may be added to the base layer as necessary, such as an antioxidant, thermal stabilizer, plasticizer, light stabilizer, lubricant, anti-fogging agent, anti-blocking agent, roughening particles, slipping agent, crosslinking agent, crosslinking coagent, adhesive, flame retardant, dispersant, and the like. As necessary, a known reinforcing filler may also be added, such as glass fiber, carbon fiber, talc, mica, titanium oxide, calcium carbonate, or the like.

In order to improve adhesiveness to the surface layer, the base layer may be subjected to known surface treatment such as primer treatment, plasma treatment, corona treatment, or the like. When the surface layer is provided directly on the base layer, the surface of the base layer at the surface layer side may include a region that is permeated by the ultraviolet curable resin, solvent, and the like in the resin composition forming the surface layer.

<Surface Layer>

In the conductive endless belt according to this disclosure, the surface layer is a member formed on the outermost surface of the outer periphery of the base layer and is an essential component for providing the conductive endless belt with excellent toner releasability.

The surface layer is formed from a resin composition including ultraviolet curable resin and silicone resin.

The ultraviolet curable resin and silicone resin that are essential components of the resin composition and other components that may be added as necessary are now described in order with examples.

(Ultraviolet Curable Resin)

Ultraviolet curable resin is a component that hardens upon irradiation with ultraviolet light and can form a matrix (also called a binder) of the surface layer. Ultraviolet curable resin used in a known conductive endless belt may be used as the ultraviolet curable resin. Non-limiting examples of such ultraviolet curable resin include polyester resin, polyether resin, fluororesin, epoxy resin, amino resin, polyamide resin, acrylic resin, acrylic urethane resin, urethane resin, alkyd resin, phenol resin, melamine resin, urea resin, polyvinyl butyral resin, and the like. In accordance with the desired performance or the like, these resins may be used alone, or two or more kinds may be used in combination. Note that the below-described "silicone resin" is not included in the "ultraviolet curable resin" in this disclosure.

(Silicone Resin)

The silicone resin in this disclosure has the function of providing the surface layer of the conductive endless belt according to this disclosure with excellent toner releasability.

The silicone resin in this disclosure includes polysiloxane containing, per molecule, 4 or more (meth)acryloyl groups.

In one of the embodiments of this disclosure, the silicone resin is polysiloxane containing, per molecule, 4 or more (meth)acryloyl groups.

In one of the embodiments of this disclosure, the 4 or more functional groups are all acryloyl groups.

In another one of the embodiments of this disclosure, the 4 or more functional groups are all methacryloyl groups.

In another one of the embodiments of this disclosure, the 4 or more functional groups are a combination of acryloyl group(s) and methacryloyl group(s).

While not wishing to be bound by theory, it is believed that by the polysiloxane in this disclosure containing, per molecule, 4 or more (meth)acryloyl groups, a three-dimensional crosslinked structure forms between molecules of polysiloxane and between the polysiloxane and the aforementioned ultraviolet curable resin at the time of hardening, thereby suppressing a reduction in the toner releasability of the conductive endless belt.

It suffices for the polysiloxane in this disclosure to contain, per molecule, 4 or more (meth)acryloyl groups, which may be contained in either or both of the main chain and the side chain of a polymer molecule of polysiloxane.

The total number of (meth)acryloyl groups per molecule in the polysiloxane is preferably 4 to 8.

In one of the embodiments of this disclosure, the polysiloxane contains 4 or more (meth)acryloyl groups on both terminals of the main chain in the polymer molecule of polysiloxane.

In another one of the embodiments of this disclosure, the polysiloxane contains 4 or more (meth)acryloyl groups on one of the terminals of the main chain in the polymer molecule of polysiloxane.

In another one of the embodiments of this disclosure, the polysiloxane contains 4 or more (meth)acryloyl groups on the side chain in the polymer molecule of polysiloxane.

In another one of the embodiments of this disclosure, the polysiloxane contains a total of 4 or more (meth)acryloyl groups on the main chain and the side chain in the polymer molecule of polysiloxane.

The repeating unit in the main chain of the polysiloxane may be expressed by the general formula $—[SiR_2O]_n—$, where each R bonded to a silicon atom independently represents a hydrogen atom or a monovalent hydrocarbon group. The monovalent hydrocarbon group may, but does not need to, contain a hetero atom such as N, O, S, or F.

The number of carbon atoms in the aforementioned monovalent hydrocarbon group represented by R is, for example, 1 to 20, preferably 1 to 9, more preferably 1 to 6, and particularly preferably 1.

Non-limiting examples of the aforementioned R include linear or branched alkyl groups such as methyl groups, ethyl groups, propyl groups, and butyl groups; aryl groups such as phenyl groups; aralkyl groups such as benzyl groups; polyalkylene oxides such as polyethylene oxides and polypropylene oxides; fluoroalkyl groups; —OCOR' (where R' is a monovalent hydrocarbon group with 1 to 20 carbon atoms); a —R"NHCOR' group (where R' is as described above, and R" is a divalent hydrocarbon group with 1 to 20 carbon atoms); and other unreactive groups.

Other non-limiting examples of the aforementioned R include amino groups; epoxy groups; alicyclic epoxy groups; —R"OH groups (where R" is as described above); —R"SH groups (where R" is as described above); —R"COOH groups (where R" is as described above); and other reactive groups.

In one of the disclosed embodiments, each R in the aforementioned repeating unit is a methyl group.

In another one of the disclosed embodiments, each R in the aforementioned repeating unit is a phenyl group.

In another one of the disclosed embodiments, one R in the aforementioned repeating unit is a hydrogen atom, and the other R is a methyl group.

In another one of the disclosed embodiments, one R in the aforementioned repeating unit is a hydrogen atom, and the other R is a phenyl group.

In another one of the disclosed embodiments, one R in the aforementioned repeating unit is a methyl group, and the other R is a phenyl group.

In the conductive endless belt according to this disclosure, the silicone resin is preferably polydimethylsiloxane containing, per molecule, 4 or more acryloyl groups. As a result, a good effect of suppressing the reduction in toner releasability of the conductive endless belt is easily obtained. A suitable example of polydimethylsiloxane containing 4 or more acryloyl groups is BYK®-UV3570 (BYK is a registered trademark in Japan, other countries, or both) produced by BYK Japan Co., Ltd.

The BYK®-UV series containing 4 or more (meth)acryloyl groups per molecule may also be used.

The (meth)acryloyl groups in the polysiloxane may be directly bonded to the main chain or may form all or a portion of the side chain.

Alternatively, the (meth)acryloyl groups in the polysiloxane may be bonded to the main chain or the side chain via a joining segment such as a polyester segment; a polyether segment such as ethylene oxide, propylene oxide, or a combination thereof; or the like. In other words, the polysiloxane may be a polyester modified siloxane or a polyether modified siloxane containing (meth)acryloyl groups.

In a scope that does not deviate from the spirit of this disclosure, the silicone resin according to this disclosure may include polysiloxane containing 1 to 3 (meth)acryloyl groups. The inclusion ratio of polysiloxane containing 4 or more (meth)acryloyl groups with respect to the total amount of silicone resin is preferably 50% or more by mass and more preferably 100% by mass.

As the silicone resin, one kind of the above-described polysiloxane may be used alone, or two or more kinds may be used in combination.

The content of the silicone resin may be any value and may be adjusted appropriately in accordance with use, with the desired toner releasability, or the like.

For example, the content of the silicone resin may be 0.1 parts by mass or more per 100 parts by mass of the ultraviolet curable resin. Setting the content of the silicone resin to be 0.1 parts by mass or more facilitates the provision of sufficient toner releasability to the conductive endless belt.

In one of the embodiments of this disclosure, from the perspective of adhesiveness between the base and the surface layer, the content of the silicone resin is preferably 2.0 parts by mass or less, more preferably less than 1.0 parts by mass, and particularly preferably 0.5 parts by mass or less per 100 parts by mass of the ultraviolet curable resin. Setting the content of the silicone resin to be 0.5 parts by mass or less can suppress a reduction in toner releasability and also yields excellent adhesiveness between the base and the surface layer.

(Optional Components in the Resin Composition)

In addition to the ultraviolet curable resin and the silicone resin, a known additive may be added to the resin composition as appropriate in accordance with use or with performance, such as the desired toner releasability, in a scope that does not deviate from the spirit of this disclosure. Examples of such additives include a conductive agent, antioxidant, thermal stabilizer, plasticizer, light stabilizer, lubricant, anti-fogging agent, anti-blocking agent, slipping agent, cross-linking agent, crosslinking coagent, adhesive, antifouling agent, flame retardant, dispersant, and the like. In order to improve coatability of the resin composition, a solvent such as methyl ethyl ketone may be added to the resin composition.

The content of the optional components in the resin composition may be any value appropriately adjusted in accordance with use, the desired properties, or the like. For example, in the case of a conductive agent, the content may be 0.1 to 20 parts by mass per 100 parts by mass of the ultraviolet curable resin. Other optional components may, for example, be 0.01 to 10 parts by mass per 100 parts by mass of the ultraviolet curable resin.

The resin composition forming the surface layer may be prepared by mixing each of the aforementioned components using an appropriate solvent. Any method of preparing the resin composition may be used. For example, a known application method such as spray coating, dip coating, roll coating, gravure coating, or the like may be used to form a coating film. The coating film may then be dried, and the dried coating film irradiated with ultraviolet light to harden the resin composition, thereby forming the surface layer.

The cumulative irradiation energy during ultraviolet irradiation may be adjusted as appropriate and may, for example, be in a range of 100 $mJ/cm^2$ to 1500 $mJ/cm^2$.

The surface layer may have any thickness within a range that guarantees conductivity as a conductive endless belt and may be set to the thickness of a known surface layer. The thickness of the surface layer may, for example, be from 0.1 μm to 2.0 μm.

(Other Layers)

Other layers of the conductive endless belt according to this disclosure for example include a primer layer for improving adhesiveness between the base layer and the surface layer. A known acrylic primer layer may be used as the primer layer.

(Peel Force of Surface Layer)

As a method of evaluating the toner releasability of the surface layer, the following rate of change of the peel force may be used. As the peel force is smaller, the force required to peel toner from the surface of the surface layer is smaller. Hence, the toner releasability is better. Furthermore, as the rate of change of the peel force is smaller, the effect of suppressing a reduction in the toner releasability is better.

In a preferred embodiment of the conductive endless belt according to this disclosure, the rate of change of the peel force after a simplified endurance test with respect to the initial peel force on the surface layer is preferably 200% or less, where the rate of change is represented by the following equation.

$$\text{rate of change (\%)} = ((\text{peel force in N after simplified endurance test} - \text{initial peel force in N}) / \text{initial peel force in N}) \times 100$$

(Conductive Endless Belt for Uses Other than Intermediate Transfer Belt)

As described above, the resin composition including ultraviolet curable resin and polysiloxane containing, per molecule, 4 or more (meth)acryloyl groups can achieve excellent toner releasability upon being hardened. Therefore, in addition to being used as an intermediate transfer belt, the conductive endless belt of this disclosure is useful as a transfer belt for a toner cartridge in an image forming apparatus.

(Image Forming Apparatus)

An image forming apparatus according to this disclosure includes the conductive endless belt as an intermediate transfer belt.

As a result, the image forming apparatus according to this disclosure can suppress a reduction in the toner releasability of the intermediate transfer belt, thus yielding excellent image quality. Furthermore, the effect of a reduction in waste toner is also achieved.

Apart from using the conductive endless belt according to this disclosure as the intermediate transfer belt, the image forming apparatus may have the structure of an image forming apparatus with a known intermediate transfer belt system.

EXAMPLES

The following provides further illustration through examples, but these examples are only provided for illustration and in no way limit this disclosure.

As the base layer, polyester resin (length of 75 mm, width of 25 mm, resistivity of $10^{10}$ Ω·cm) was used.

The following components were used as the components of the resin composition in the surface layer.

Ultraviolet curable resin 1 (pentaerythritol triacrylate hexamethylene diisocyanate urethane prepolymer): product name UA-306H, produced by Kyoeisha Chemical Co., Ltd.

Ultraviolet curable resin 2 (bifunctional acrylate): product name LIGHT ACRYLATE 14EG-A, produced by Kyoeisha Chemical Co., Ltd.

Ultraviolet curable resin 3 (dipentaerythritol hexaacrylate): product name LIGHT ACRYLATE DPE-6A, produced by Kyoeisha Chemical Co., Ltd.

Ultraviolet curable resin 4 (trimethylolpropane triacrylate): product name LIGHT ACRYLATE TMP-A, produced by Kyoeisha Chemical Co., Ltd.

Ultraviolet curable resin 5 (phenoxyethyl acrylate): product name LIGHT ACRYLATE PO-A, produced by Kyoeisha Chemical Co., Ltd.

Ultraviolet curable resin 6 (methoxy-triethylene glycol acrylate): product name LIGHT ACRYLATE MTG-A, produced by Kyoeisha Chemical Co., Ltd.

Silicone resin 1 (polydimethylsiloxane with 4 acryloyl groups): product name BYK®-UV3570, produced by BYK Japan Co., Ltd.

Silicone resin 2 (1 acryloyl group): product name X22-2458, produced by Shin-Etsu Chemical Co., Ltd.

Silicone resin 3 (polydimethylsiloxane with 2 acryloyl groups): product name BYK®-UV3500, produced by BYK Japan Co., Ltd.

Photopolymerization initiator (1-hydroxycyclohexane-1-yl phenyl ketone): product name Irgacure184, produced by BASF Conductive agent (antimony-doped tin oxide): product name ATO-T-7722G-496-AA, produced by Resino Color Industry Co., Ltd.

Conductive agent (carbon dispersion): product name A223, produced by Mikuni Color Ltd.

Conductive agent (ion conductive agent): product name Sankonol® (Sankonol is a registered trademark in Japan, other countries, or both) MTG-A-50R, produced by Sanko Chemical Industry Co., Ltd.

TABLE 1

| Type | Component name (product name) | Content (parts by mass) |
|---|---|---|
| ultraviolet curable resin 1 | UA-306H | 70 |
| ultraviolet curable resin 2 | LIGHT ACRYLATE 14EG-A | 30 |
| silicone resin | listed in Table 2 | listed in Table 2 |
| photopolymerization initiator | Irgacure184 | 3 |
| conductive agent | ATO-T-7722G-496-AA | 14.5 |
| roughening particles | KTL-2N | 1.2 |
| dispersant | Disparlon DA-325 | 0.06 |
| fluorine oligomer | MEGAFACE RS-72-K | 1 |

TABLE 2

| | Silicone resin type (product name) | Number of acryloyl groups (functional groups) | Content (parts by mass) | Initial peel force (N) | Peel force after simplified endurance test (N) | Rate of change (%) | Adhesion with cross-cut method |
|---|---|---|---|---|---|---|---|
| Example 1 | Silicone resin 1 (BYK ®-UV3570) | 4 | 0.10 | 1.2 | 1.2 | 0 | excellent |
| Example 2 | | | 0.15 | 1.1 | 1.5 | 36 | excellent |
| Example 3 | | | 0.20 | 1.3 | 1.2 | −8 | excellent |
| Example 4 | | | 0.30 | 1.2 | 1.3 | 10 | excellent |
| Example 5 | | | 0.45 | 0.4 | 1.1 | 175 | excellent |
| Example 6 | | | 0.50 | 1.0 | 1.0 | 0 | excellent |
| Example 7 | | | 1.00 | 0.6 | 0.7 | 17 | good |
| Example 8 | | | 2.00 | 0.6 | 0.6 | 0 | good |
| Comparative Example 1 | Silicone resin 2 (X22-2458) | 1 | 0.15 | 0.3 | 2.3 | 667 | poor |
| Comparative Example 2 | | | 0.30 | 0.4 | 2.2 | 450 | poor |
| Comparative Example 3 | | | 0.45 | 0.2 | 2.1 | 950 | poor |
| Comparative Example 4 | Silicone resin 3 (BYK ®-UV3500) | 2 | 0.15 | 0.3 | 2.0 | 567 | poor |
| Comparative Example 5 | | | 0.30 | 0.3 | 2.3 | 667 | fair |
| Comparative Example 6 | | | 0.45 | 0.2 | 2.0 | 900 | poor |

Roughening particles (fine powder of polytetrafluoroethylene, additive for controlling surface roughness): product name KTL-2N, produced by Kitamura Ltd.

Roughening particles (polydisperse particles of cross-linked acrylic): product name KMR-3TA, produced by Soken Chemical & Engineering Co., Ltd.

Dispersant of roughening particles (amine salt of polyether phosphate ester): product name Disparlon DA-325, produced by Kusumoto Chemicals, Ltd.

Reactive fluorine oligomer (antifouling agent): product name MEGAFACE RS-72-K, produced by DIC Corporation Examples 1 to 8 and Comparative Examples 1 to 6

For each of the Examples and Comparative Examples, the following surface layer was formed over the entire outer periphery of the aforementioned base layer to yield a conductive endless belt with a length of 75 mm and a width of 25 mm. First, resin compositions were prepared by dissolving the materials with the compositions listed in Table 1 and Table 2 in Methyl Ethyl Ketone (MEK) to a solid content concentration of 5% by mass. Next, the resin compositions were applied by spray coating to the aforementioned base layer to form a coating film. The coating film was then dried at 90° C. for 5 min. Next, the coating film was hardened by ultraviolet irradiation to form a surface layer with a thickness of 2 μm.

(Evaluation of Toner Releasability)

To evaluate the toner releasability of the surface layer in the conductive endless belt obtained in this way, the peel force immediately after production (initial peel force) and the peel force after a simplified endurance test were measured. Table 2 lists the results of measurement and the rate of change of the peel force after the simplified endurance test with respect to the initial peel force, as represented by the following equation.

rate of change (%)=((peel force in N after simplified endurance test−initial peel force in N)/initial peel force in N)×100

As the rate of change is smaller, the effect of suppressing a reduction in the toner releasability is better.

Figure 2:
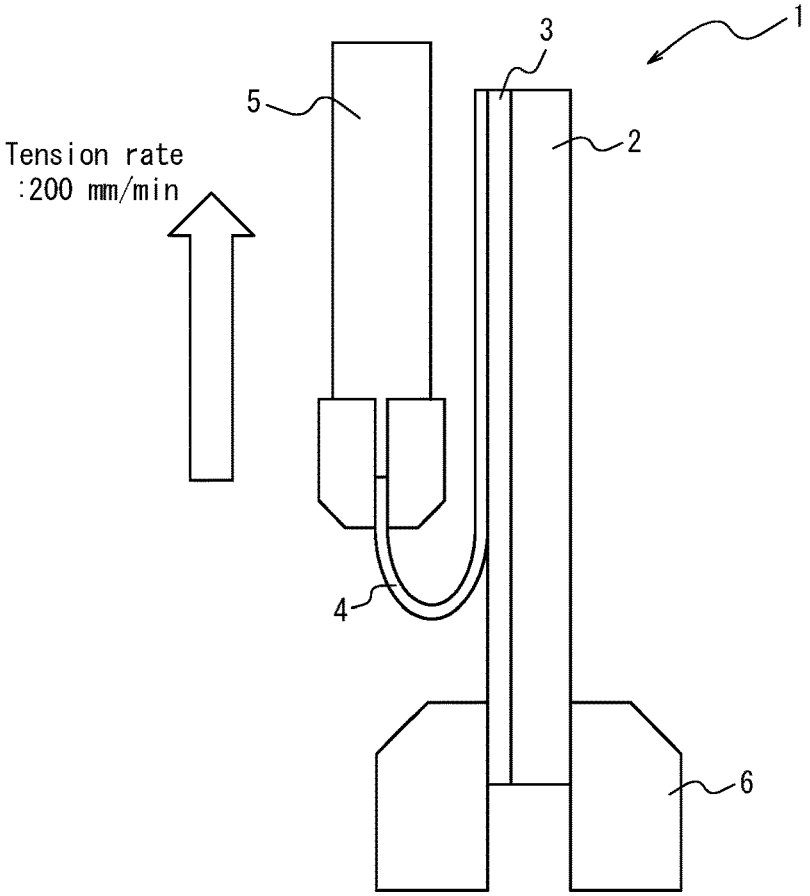
FIG. 2 schematically illustrates an example of a method for measuring peel force in this disclosure.
Figure 3:
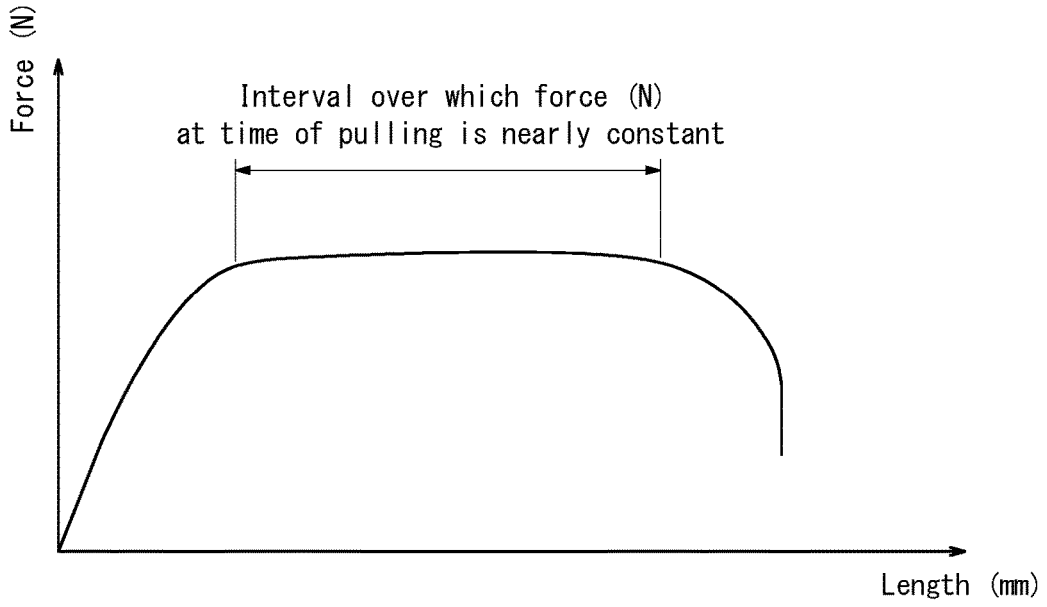
FIG. 3 is a graph schematically illustrating an example of the relationship between time and force when peeling cellophane adhesive tape in the method for measuring peel force in this disclosure.
Figure 4:
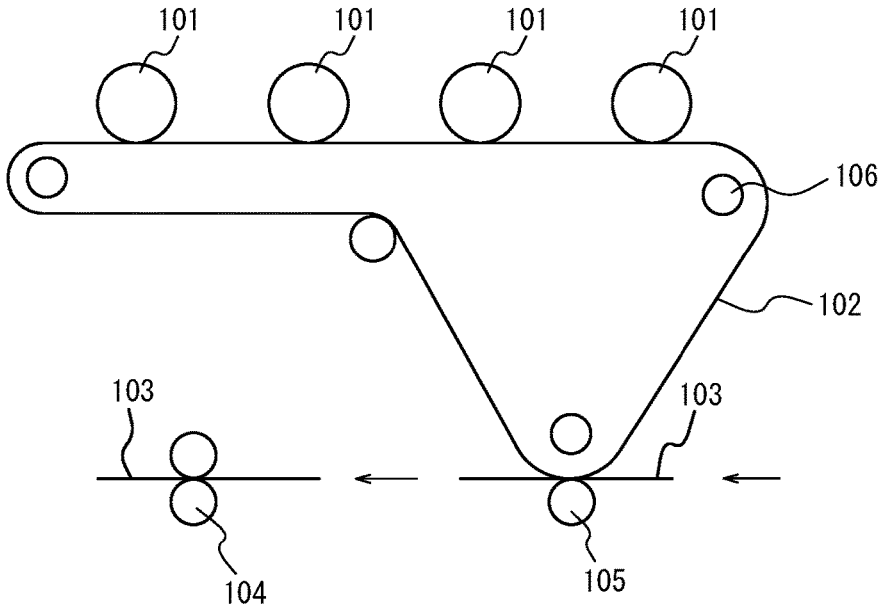
FIG. 4 is a partial schematic diagram illustrating an example of an image forming apparatus.

The peel force of the surface layer was measured by the following method, as illustrated in FIGS. 2 and 3. First, a conductive endless belt 1 measuring 75 mm long by 25 mm wide was prepared. Next, onto the surface of a surface layer 3 thereof, a length of 45 mm of cellophane adhesive tape 4 (product name Cellotape® CT-18), produced by Nichiban Co., Ltd. and measuring 55 mm long by 18 mm wide, was adhered to the surface layer 3 starting at one end (turnback end) thereof. The remaining 10 mm portion of the cellophane adhesive tape was not adhered, but rather left in a peeled off state. Of the two clamps of an autoloader, one clamp 5 was then set to hold the end of the cellophane adhesive tape 4 that was in the peeled off state, and the other clamp 6 was set to hold the end of the conductive endless belt 1 to which the cellophane adhesive tape 4 was not adhered. Next, at a tension rate of 200 mm/min, the clamp 5 was pulled in a direction at 180° with respect to the clamp 6 until all of the cellophane adhesive tape 4 was peeled from the surface layer 3, and the force (N) at the time of pulling was measured. As illustrated in FIG. 3, the average was calculated for the interval over which the force (N) at the time of pulling was nearly constant (at least 70 mm). This average was taken as the peel force (N).

The simplified endurance test was performed by rubbing a wiper (produced by Chiyoda Co., Ltd., product name Cotton Ciegal) measuring 20 mm×20 mm and impregnated with methanol (1 mL) against the surface of the surface layer of a conductive endless belt with a load of 4.9 N (0.5 kgf) back and forth 50 times.

(Adhesion of Surface Layer of Conductive Endless Belt with Respect to Base Layer)

The adhesion of the surface layer of the conductive endless belt with respect to the base layer after the simplified endurance test for each Example and Comparative Example was evaluated based on the following evaluation criteria in conformity with the cross-cut method of JIS K5600-5-6. Table 2 also lists the results of this evaluation.

Excellent: classification score of 0 upon testing with the cross-cut method

Good: classification score of 1 upon testing with the cross-cut method

Fair: classification score of 2 upon testing with the cross-cut method

Poor: classification score of 3 or higher upon testing with the cross-cut method Table 2 shows that for Comparative Examples 1 to 3 in which the number of acryloyl groups in the silicone resin was 1, the rate of change of the peel force was 450% to 950%, and for Comparative Examples 4 to 6 in which the number of acryloyl groups in the silicone resin was 2, the rate of change of the peel force was 567% to 900%. The peel force after the simplified endurance test thus increased greatly. These results demonstrate that in the conductive endless belt of the Comparative Examples, the toner releasability was greatly reduced.

By contrast, in Examples 1 to 8, the rate of change was 175% for Example 5 and was 40% or less for the other examples. For Examples 1, 6, and 8, the rate of change was 0%. As compared to the Comparative Examples, the rate of change was thus extremely reduced in the Examples. It is thus clear that the conductive endless belt of the Examples achieves an excellent effect of suppressing a reduction in toner releasability.

Furthermore, the results of evaluating adhesion with the cross-cut method showed that when the content of the silicone resin is 0.5 parts by mass or less, excellent adhesiveness between the base layer and the surface layer was obtained in addition to suppressing a reduction in toner releasability.

Examples 9 to 13

In Examples 9 to 13, other than using materials with the compositions listed in Table 3, resin compositions were prepared in the same way as in Example 1 to form a surface layer with a thickness of 2 μm.

As in Example 1, the initial peel force and the peel force after a simplified endurance test were measured for the surface layer of the conductive endless belt obtained in Examples 9 to 13.

The adhesion with respect to the base layer was measured for Examples 9 to 13 for the surface layer of the conductive endless belt after the simplified endurance test as in Example 1.

Table 3 also lists the results of these measurements.

TABLE 3

| | Type (product name) | Example 9 | Example 10 | Example 11 | Example 12 | Example 13 |
|---|---|---|---|---|---|---|
| Content (parts by mass) | ultraviolet curable resin 1 (UA-306H) | | | 70 | 70 | 70 |
| | ultraviolet curable resin 3 (DPE-6A) | 70 | | | | |
| | ultraviolet curable resin 4 (TMP-A) | | 70 | | | |
| | ultraviolet curable resin 2 (14EG-A) | | | 30 | 30 | 30 |
| | ultraviolet curable resin 5 (PO-A) | 30 | | | | |
| | ultraviolet curable resin 6 (MTG-A) | | 30 | | | |
| | silicone resin (BYK ®-UV3570) | 0.3 | 0.3 | 0.3 | 0.3 | 0.3 |
| | photopolymerization initiator (Irgacure184) | 3 | 3 | 3 | 3 | 3 |
| | conductive agent (ATO-T-7722G-496-AA) | 14.5 | 14.5 | | | 14.5 |
| | conductive agent (A223) | | | 2 | | |
| | conductive agent (MTG-A-50R) | | | | 1 | |
| | roughening particles (KTL-2N) | 1.2 | 1.2 | 1.2 | 1.2 | |
| | roughening particles (KMR-3TA) | | | | | 1 |
| | dispersant (DA-325) | 0.06 | 0.06 | 0.06 | 0.06 | |
| | fluorine oligomer (RS-72-K) | 1 | 1 | 1 | 1 | 1 |

TABLE 3-continued

| | Type (product name) | Example 9 | Example 10 | Example 11 | Example 12 | Example 13 |
|---|---|---|---|---|---|---|
| Performance evaluation | initial peel force (N) | 1.2 | 1.5 | 1.1 | 1.3 | 1.4 |
| | peel force after simplified endurance test (N) | 1.3 | 1.4 | 1.3 | 1.2 | 1.2 |
| | adhesion with cross-cut method | excellent | excellent | excellent | excellent | excellent |

REFERENCE SIGNS LIST

1 Conductive endless belt
2 Base layer
3 Surface layer
4 Cellophane adhesive tape
101 Photosensitive drum
102 Intermediate transfer belt
103 Recording medium
104 Fixer
105 Secondary transfer roller
106 Roller

The invention claimed is:

1. A conductive endless belt used in an image forming apparatus, the conductive endless belt comprising: at least an endless base layer and a surface layer formed on an outermost surface of an outer periphery of the base layer; wherein the surface layer is formed from a resin composition including at least one ultraviolet curable resin and silicone resin: and the silicone resin includes polysiloxane containing, per molecule, 4 or more of at least one of an acryloyl group and a methacryloyl group, wherein a content of the silicone resin in the resin composition is 0.1 parts by mass or more to 0.5 parts by mass or less per 100 parts by total mass of the ultraviolet curable resin.

2. The conductive endless belt of claim 1, wherein the silicone resin is polydimethylsiloxane containing, per molecule, 4 or more acryloyl groups.

3. The conductive endless belt of claim 1, wherein a rate of change of a peel force after a simplified endurance test with respect to an initial peel force on the surface layer is 200% or less, the rate of change being represented by the following equation:

rate of change (%)=((peel force in N after simplified endurance test−initial peel force in N)/initial peel force in N)×100.

4. An image forming apparatus comprising the conductive endless belt of claim 1 as an intermediate transfer belt.

* * * * *